US005171137A

United States Patent [19]

Todescat et al.

[11] Patent Number: 5,171,137

[45] Date of Patent: Dec. 15, 1992

[54] VALVE FOR A HERMETIC REFRIGERATION COMPRESSOR

[75] Inventors: Marcio L. Todescat; Jose L. Driessen; Dietmar E. B. Lilie, all of Joinville - SC, Brazil

[73] Assignee: Empressa Brasielira de compressores S/A-EMRACO, Joinville-SC, Brazil

[21] Appl. No.: 715,818

[22] Filed: Jun. 14, 1991

[30] Foreign Application Priority Data

Jun. 19, 1990 [BR] Brazil ..... 9002967

[51] Int. Cl.[5] ..... F04B 21/02; F16K 15/00

[52] U.S. Cl. ..... 417/571; 137/521

[58] Field of Search ..... 137/521, 857; 417/571

[56] References Cited

U.S. PATENT DOCUMENTS 4,628,963 12/1986 Ishijima ..... 137/857
4,759,696 7/1988 Ishiai ..... 137/521
4,778,360 10/1988 Ikeda ..... 417/571

*Primary Examiner*—Leonard E. Smith
*Assistant Examiner*—Roland McAndrews
*Attorney, Agent, or Firm*—Darby & Darby

[57] ABSTRACT

Valve for a hermetic refrigeration compressor, having a cylinder block (10) with a cylinder (C) and a piston (20). A valve plate (30) attached to the cylinder block (10) has at least one axial gas passage (31, 32) communicating the inside of the cylinder (C) with the front face (30*a*) of the valve plate (30) through a respective reed valve at the outlet end (31*b*, 32*b*) of the respective gas passage (31, 32). The valve has a blade element (60, 80) and a biasing means (70, 90) disposed between the blade element (60, 80) and the valve plate (30) to displace said blade element to a partial opening position of the valve upon occurrence of pressure balance between the upstream and downstream regions of the valve, the biasing means (70, 90) itself being elastically deformed by the blade element (60, 80) when the valve closes, whenever the gas pressure downstream the valve exceeds the gas pressure upstream thereof.

11 Claims, 3 Drawing Sheets

VALVE FOR A HERMETIC REFRIGERATION COMPRESSOR

FIELD OF THE INVENTION

The present invention relates to hermetic refrigeration compressors and, more particularly, to suction and discharge valves used in relatively small compressors which are generally found in domestic refrigeration.

BACKGROUND OF THE INVENTION

In hermetic compressors of the reciprocating type and with little displacement volume (small cylinder capacity), both suction and discharge valves exert a strong influence on the compressor performance.

The valve plate and valve blade assemblies that form the valve systems as a whole, act directly on the energy and mass efficiency of the compressor.

Energy losses in the compressor are basically characterized by the resistance of the valve to open readily and by the restriction of flow during the admission or discharge of gas. Such losses are directly related to the speed and readiness of the blades to move to the valve opening position.

The predominant factors contributing to the occurrence of said losses, mainly those caused by the delay in the opening of the blades, are the following:

inadequate shape of geometry of the gas orifice and/or the valve seat, preventing the valve from having a maximum effective force area for the initial opening of the blade;

blade inertia, caused by blade overweight (mass) and/or inadequate geometry; and blade adhering sticking to the valve plate due to the presence of viscous lubricant oil.

When these factors occur in the suction valve, they exert strong influence on the volumetric efficiency of the compressor. In the case of the discharge valve, the losses are basically energetic, i.e. overpressure losses to impel the blade to initiate its opening.

The types of valve systems that are normally used and/or proposed nowadays are of the type described in U.S. Pat. Nos. 4,642,037 and 4,580,604. In these prior art valve systems, the only object of the invention is to minimize the delay in the opening of the blade by reducing the adherence (sticktion or sticking) effect caused by the viscosity of the lubricant oil.

However, another problem of fundamental importance is still unsolved, i.e. to minimize the inertia effect of the blade, mainly at the initial moment of the valve opening. The reduction of the weight (mass) of the blade and, consequently, of its inertia, taking into account the materials available nowadays, is more efficiently obtained by reducing the blade thickness. However, this can lead to excessively high strain on the blade, mainly on the region over the orifice. As a result, it would be necessary to reduce the diameter of the orifice, thereby reducing the effective force and flow areas and consequently the performance of the compressor.

It should also be understood that, although the suction and discharge valves operate under rather different conditions, the above mentioned aspects are common for both valves.

SUMMARY OF THE INVENTION

The object of the present invention is to provide a valve system either of the suction or discharge upon which is able to increase the energy and volumetric efficiencies of the compressor by reducing the adherence and inertia effects of the blade during the initial moments of its opening, without causing any reduction in the desirable diameter of the gas orifice and in the blade thickness.

The reed valve object of the present invention is used in reciprocating hermetic compressors comprising a cylinder block having an end face; a cylinder formed in said cylinder block, and having an end that is opened to said end face of the block. A reciprocating piston is mounted inside the cylinder; a valve plate having a front face and a rear opposite face is attached to the block end face at the cylinder open end. The valve plate has at least one pair of axial gas orifices providing communication between the cylinder interior and the front face of the valve plate through a respective reed valve.

Each reed valve comprises a flexible blade element having a basic portion attached to the face of the valve plate to which is opened an outlet end of the respective gas orifice and a sealing portion, which is movable between a closing position, seated on the outlet end of the gas orifice, and an opening position, spaced apart from said outlet end of the gas orifice. The motion of the blade sealing portion is obtained by the elastic deformation of the blade element, due to the pressure differential between the cylinder inside and the front face of the valve plate.

According to the present invention, each reed valve further comprises biasing means which is mounted between the respective blade element and the valve plate, so as to constantly bias the sealing portion of the blade element to a partial opening position of the valve. The biasing means is dimensioned to instantly displace the sealing portion of the blade element to the partial opening position of the valve when pressure balance is achieved between the cylinder inside and the valve plate front face in the gas orifice region. The sealing portion of the blade element is displaced to a maximum opening position of the valve when the gas pressure upstream of the valve exceeds the gas pressure downstream thereof. It is displaced to a closing position, in which it is kept against the action of the biasing means, whenever the gas pressure downstream of the valve exceeds the gas pressure upstream thereof.

The valve, being constructed as described above, leads to an arrangement in which the biasing means impels the seating portion of the blade element, in its opening direction, at the initial moment of its motion towards the valve opening position.

This arrangement accomplishes a substantial reduction, not only in the opening delay due to the action of oil in the valve seat region, but also, and mainly, in the opening delay caused by the inertia of the blade element, since it is subjected to the biasing action of means whose mass is not displaced by the gas flowing through the orifices of the valve plate.

The present invention allows an additional acceleration for the sealing portion of the blade element and, consequently, a reduction in the rotating angle of the crankshaft necessary to achieve a full opening of the valve.

The biasing means can take the form of a spring mounted in a housing provided at the valve plate face to which the valve is fixed.

BRIEF DESCRIPTION OF THE DRAWINGS

The invention will hereinafter be described with reference to the drawings, in which.

DETAILED DESCRIPTION OF THE INVENTION

Figure 1:
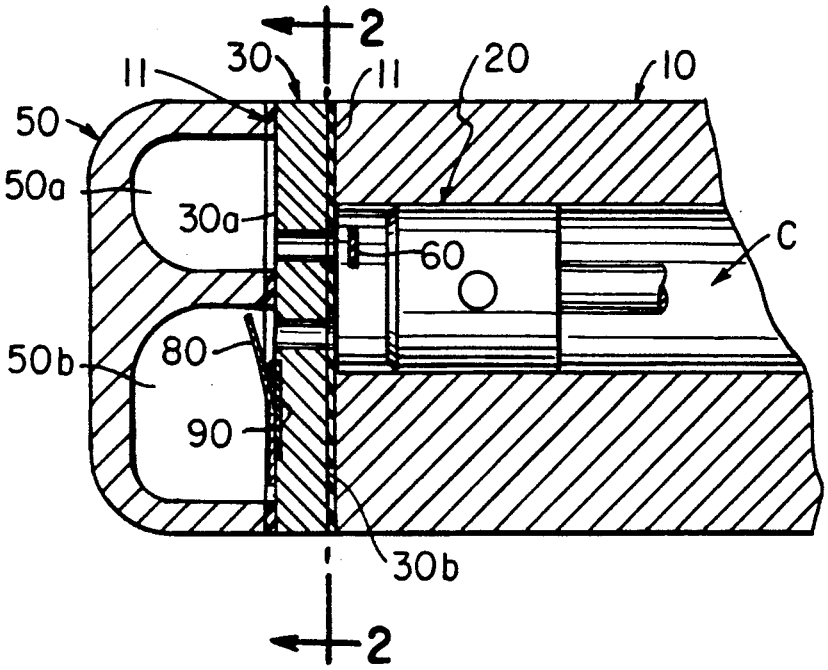
FIG. 1 shows a longitudinal partial sectional view of the cylinder block, cylinder and piston assembly of a reciprocating hermetic compressor, said sectional view being taken according to line I—I of FIG. 2.

As shown in FIG. 1, the compressor described to represent a preferred embodiment of the invention is a reciprocating compressor of the type comprising a cylinder block 10 housed within a hermetic case (not shown) and having a cylindrical cavity, which will hereinafter be called cylinder C, and inside which reciprocates a piston 20.

The cylinder block 10 has an end face to which is opened the cylinder C and against which are fixed, through gaskets 11, a valve plate 30 and a cylinder head 50 which forms, together with the valve plate 30, two inner cavities defining a suction chamber 50*a* and a discharge chamber 50*b*.

The valve plate 30 has (FIG. 3) a front face 30*a* defining the suction and discharge chambers 50*a* and 50*b*, respectively, with the cylinder head 50, and an opposite face 30*b* facing the cylinder block 10 and defining, together with the piston 20, a compressor chamber inside the cylinder C. The cylinder C is maintained in fluid communication with each of said suction chamber 50*a* and discharge chamber 50*b* through respective axial gas orifices which are provided on the valve plate 30.

In the embodiment illustrated, the front face 30*a* of the valve plate opposite to the cylinder C defines the inlet end 31*a* and the outlet end 32*b* of respectively one suction orifice 31 and one discharge orifice 32. The opposite rear face 30*b* of the valve plate defines the outlet end 31*b* and the inlet end 32*a* of the suction orifice 31 and the discharge orifice 32. The outlet ends 31*b* and 32*b* define the seats of the suction and discharge valves, respectively. At the outlet end of each axial gas orifice 31 and 32, is mounted a respective reed valve, designed according to the operational requirements of the compressor.

Figure 2:
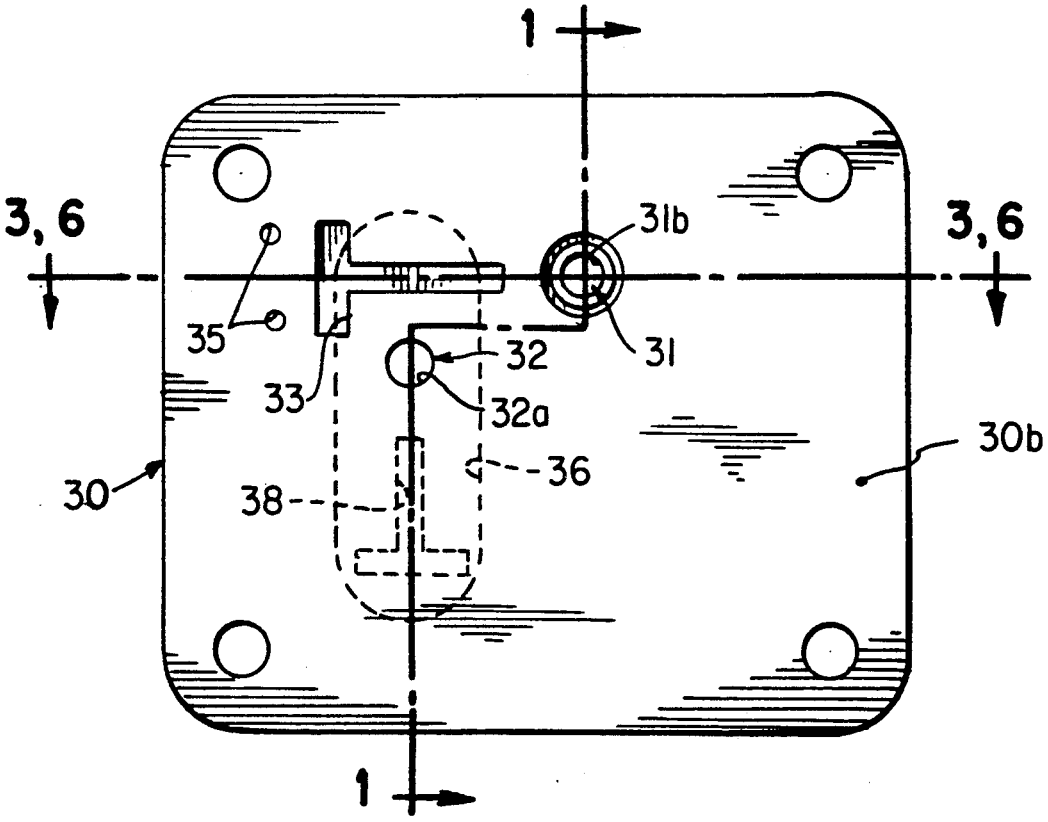
FIG. 2 shows a rear plan view of the valve plate, without the suction and discharge valves, said view being taken according to line II—II of FIG. 1.
Figure 3:
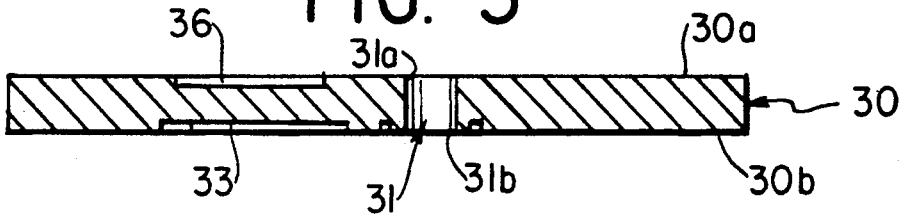
FIG. 3 is a sectional view of the valve plate of FIG. 2, taken according to line III—III of FIG. 2.
Figure 4:
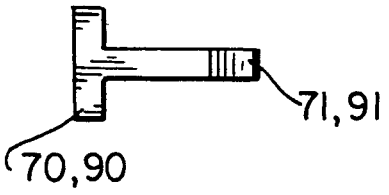
FIG. 4 is a plan view of a spring used as biasing means.
Figure 5:
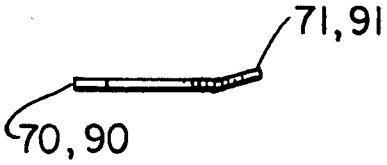
FIG. 5 illustrates a side view of the spring of FIG. 4.

FIGS. 2 and 3 illustrate the valve plate 30 constructed according to the present invention and having in its rear face 30*b* a recess 33 with a generally "T" shaped contour. The central longitudinal leg of the recess is aligned and slightly spaced apart in relation to the suction orifice 31, so as to be located exactly under the flexible suction blade element 60 illustrated in FIGS. 1, 6 and 7 and which defines the suction valve of the compressor.

The flexible suction blade element 60 has a basic fixed end portion 61 and a sealing portion 62. The basic portion 61 is fixed to the rear face 30*b* of the valve plate 30 by any known method as, for example, a pair of rivets or screws, applied through corresponding holes (not shown) provided at the basic portion 61 of the suction blade element 60 and fixed in a pair of holes 35 provided at the rear face 30*b* of the valve plate 30.

The relative positioning between the suction orifice 31, recess 33 of rear face 30*b* of the valve plate and the holes 35 which receive the means for mounting the suction blade element 60 to the valve plate 30 is designed so that said suction blade element 60 extends over the recess 33, with its sealing end portion 62 being situated immediately over the outlet end 31*b* of the suction orifice 31, in order to be able to seal said suction orifice during the gas compression part of the cycle inside the cylinder C.

According to the invention (see FIG. 6), located within the recess 33 is a laminar spring element 70 made of an adequate material, such as spring steel. Spring element 70 has a contour similar to that of said recess and an adequate thickness to permit its fitting therewithin. The laminar spring element 70 had an end portion 71 on its longitudinal center stem which is upwardly bent on a slanted plane, or in any other similar arrangement, so as to be slightly projected outwardly from the plane defined by the rear face 30*b* of the valve plate 30 under the sealing portion 62 of the suction blade element 60. The remainder of the spring element 70 remains housed inside the recess, being kept therein by the basic portion 61 of the suction blade element 60.

The deformation of the end portion 71 of the laminar spring element 70 is dimensioned to constantly and resiliently impel the sealing portion 62 of the suction blade element 60 to a position spaced apart from the outlet end 31*b* of the suction orifice 31.

On the other hand, the laminar spring element 70 is constructed so that such condition of spacing or partial opening of the sealing portion 62 of the blade element 60 in relation to the respective valve seat only occurs when the pressures inside the cylinder C and inside the suction chamber 50*a* are equal.

Figure 6:
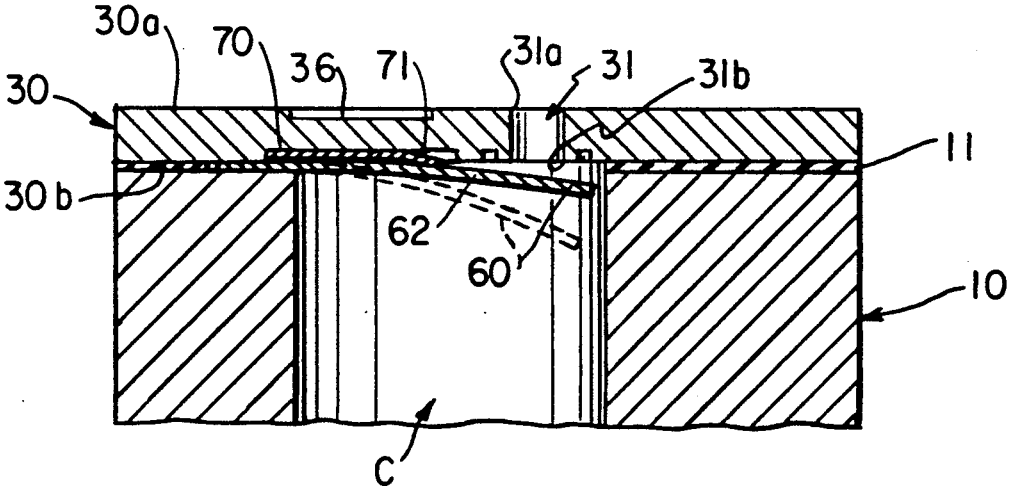
FIG. 6 is a longitudinal sectional view of the cylinder block and valve plate assembly, similar to that of FIG. 1, but sectioned according to line VI—VI of FIG. 2, said valve plate being provided with the illustrated suction valve, in full lines, in a partial opening position and, in dashed lines, in a maximum opening position.
Figure 7:
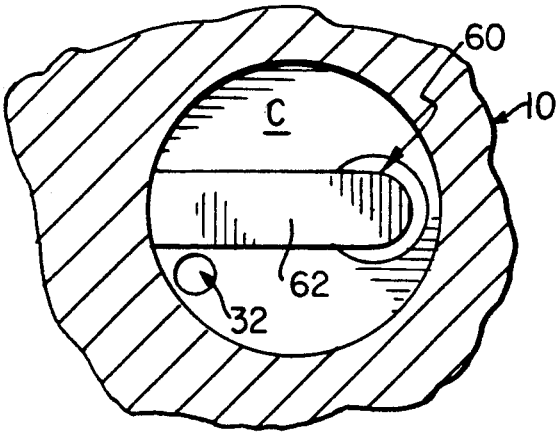
FIG. 7 shows a plan view of the suction valve illustrated in FIG. 6.

Thus, before the suction stroke of piston 20 begins, and with the pressure inside the cylinder C still being equal to the pressure inside the suction chamber 50*a*, the spring element 70 will instantly impel the blade element 60 to the partial opening position of the suction valve illustrated in FIG. 6, even before the exertion on the sealing portion 62 of said blade element 60, of any force resulting from gas pressure differential or gas flow pressure through the suction orifice 31. The bias of the spring element 70 on the blade element 60 only acts at the initial phase of the valve opening, in order to make the blade element 60 assume instantly the partial opening position corresponding to the rest position of the spring element 70.

With the end of the elastic deformation of the spring element 70 in the rest position, the blade element 60 continues its elastic deformation until it reaches the maximum opening position of the valve, shown in dashed lines in FIG. 6, by the action of the gas flow through the suction orifice 31.

When the gas flow through the suction orifice 31 has ended, soon after the end of the aspiration stroke of the piston 20, the pressure inside the cylinder C raises progressively, being momentarily balanced with the pressure inside the suction chamber 50*a*, when the blade element 60 returns to its partial opening position, being still elastically deformed by the spring element 70 in the rest condition.

When the pressure in cylinder C slightly exceeds the pressure in the suction chamber 50*a*, the blade element 60 will be displaced to the valve closing position, in which it is kept with its sealing portion 62 seated against the valve seat 31*b* of the suction valve and elastically deforming the projecting end portion 71 of the suction spring element 70.

It should be understood that the suction spring element is constructed to allow the easy closing of the valve, as soon as the downstream pressure (regarding the gas flow direction) exceeds the upstream pressure thereof. This avoids the undesirable return of gas through the valve itself, which would cause losses in the volumetric efficiency of the compressor.

The construction of the discharge valve according to the present invention follows the same principles that were defined in relation to the suction valve. As illustrated in FIGS. 2, 3, 8 and 9, the outlet end 32*b* of the discharge orifice 32 is positioned at the bottom of an oblong depression 36 provided on the front face 30*a* of the valve plate 30. Depression 36 is dimensioned to house the discharge valve defined by a flexible blade element 80 which has a construction which is similar to that of the blade element 60 of the suction valve. The blade element 80 of the discharge valve has a basic portion 81 attached to the bottom of the depression 36 by any suitable means, such as that used in the suction valve. As shown, at the end of a stop, element 37 lies over the end of the spring element 90. The blade 80 has a sealing portion 82, which can be displaced between the opening and closing positions of the valve, located on the outlet end 32*b* of the discharge passage 32.

At the bottom region of the depression 36 below the basic portion of the discharge blade element 80, there is provided another recess 38 which may have the same shape as the recess 33 of the suction valve in order to house and keep therewithin, with the help of the basic portion 81 of the discharge blade element 80. A discharge biasing means 90 which, in the present example, has a construction in the form of a spring steel blade which is identical to that of the suction biasing means 70. The discharge spring, or biasing means 90, also has a portion 91, outwardly projecting from the plane of the front face 30*a* of the valve plate 30, under the sealing portion 82 of the discharge blade element 80. The remainder of the discharge spring element 90 remains housed inside the respective recess 38, being there retained by the basic portion 81 of the discharge blade element 80.

In the illustrated embodiment, the stop element 37, for retaining the discharge blade element 80, takes the form of a metallic stem with a middle main extension being disposed in the longitudinal direction of the discharge blade element 80 and spaced apart from the latter. The two end portions of the stop element 37 are bent towards the bottom of the depression 36 and provided with opposite longitudinal extensions which are fitted in the opposite end sections of the depression 36.

The deformation of the end portion 91 of the discharge spring element 90 is dimensioned to produce, on the discharge blade element 80, the same effect as described regarding the suction valve.

During the suction and compression cycles, the pressure in the discharge chamber 50*b* is kept higher than the pressure inside the cylinder C, causing the sealing portion 82 of the discharge blade element 80 to completely seat on the outlet end 32*b* of the discharge orifice 32, said outlet end 32*b* defining the seat of the discharge valve, which thus remains completely closed.

Figure 8:
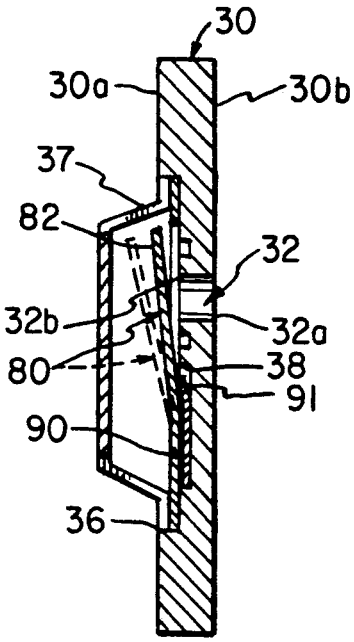
FIG. 8 shows a cross section of the valve plate, taken according to line VIII—VIII of FIG. 9 and illustrating the discharge valve in a partial opening position, in full lines, and in a maximum opening position in dashed lines.
Figure 9:
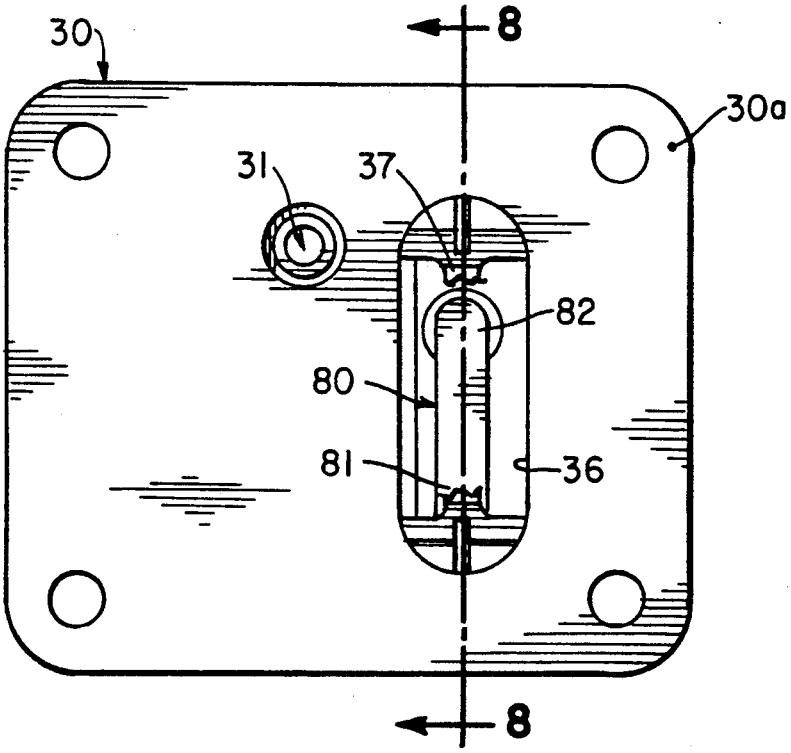
FIG. 9 illustrates a front plan view of the assembly of FIG. 8.

When the pressure balance is achieved between the cylinder C and discharge chamber 50*b* at the end of the compression cycle, the end portion 91 of the discharge spring element 90, which has been elastically deformed by the closing condition of the blade element 80, instantly impels the sealing portion 82 thereof to the partial opening condition, as illustrated in full lines in FIG. 8. This minimizes the energy losses caused by overpressure to open the valve. With the end of the elastic deformation of the spring element 90 in the rest position, the blade element 80 continues to elastically deform, till it reaches the maximum opening position of the valve, as shown in dashed lines in FIG. 8.

When the gas flow through the discharge orifice 32 stops, soon after the end of the compression stroke of the piston 20, the pressure inside the cylinder C decreases, being momentarily balanced with the pressure within the discharge chamber 50*b*, when the blade element 80 returns to its partial opening position with the spring element 90 remaining in the rest position.

When the pressure inside the cylinder C becomes lower than that of the discharge chamber 50*b*, the discharge blade element 80 will be displaced to the valve closing condition, in which is kept with its sealing portion 82 being seated against the seat 32*b* of the discharge valve and elastically deforming the projecting end portion 91 of the discharge spring element 90. The closing readiness of the valve, taking place immediately after a pressure unbalance downstream and upstream thereof, in the opposite direction in relation to the normal gas flow, avoids the volumetric losses due to back flow through the valves.

As can better be seen in FIGS. 6 and 8, the suction spring 70 and the discharge spring 90 are dimensioned and arranged to act under a region of the respective blade elements 60 and 80 that is offset in relation to the respective valve seat 31*b* and 32*b*. Thus, these spring elements 70 and 90 are not submitted to any direct action of gas flow or pressure differential thereon, whereas the sealing portion 62 and 82 of the respective blade elements 60 and 80 that is projected on the valve seats 31*b* and 32*b* remains free to act as the sealing means of the valves, being submitted to pressure variations occurring upstream and downstream the valve. FIGS. 6 and 8 also show that the edge of the recesses 33 and 38, the basic portion 61 and 81 of the blade elements 60 and 80, and the valve seats 31*b* and 32*b* are preferably situated on the same plane for each of said suction and discharge valves.

What is claimed is:

1. A valve for a hermetic compressor, the compressor including a cylinder with a piston movable therein, a valve plate on one end of the cylinder, said valve plate having a passage therethrough with one end in communication with the cylinder and an outlet end of the passage on the face of the valve plate, a reed valve comprising a blade element having one part attached to the valve plate and a part for sealing the outlet end of the passage, and means for biasing the sealing part of the blade to a partial opening condition of the valve, the biasing means being dimensioned to instantly displace the sealing portion of the blade element to said partial opening condition when the gas pressures upstream and downstream of the valve are balanced, the sealing portion of the blade element being displaced to a maximum opening position of the valve when the gas pressure upstream the valve exceeds the gas pressure downstream thereof, and to a closing position, in which it is kept, against the action of the biasing means whenever the gas pressure downstream the valve exceeds the gas pressure upstream thereof.

2. A valve as in claim 1, wherein the biasing means acts in a region of the blade element which is offset in relation to the outlet end of said passage of the valve pate.

3. A valve as in claim 2, wherein the biasing means acts in a median region of the blade element.

4. A valve as in claim 1, wherein the biasing means is retained in a recess of the valve plate and being further provided with an end portion that projects outwardly from said recess to displace the blade element to said partial opening position of the valve when there is a pressure balance between the upstream and downstream region of the valve, said end portion being housed in the recess when the valve closes.

5. A valve as in claim 4, wherein the edge of said recess is coplanar to the attaching surface of the basic portion of the blade element and to the outlet end of said passage, the biasing means being integrally housed inside the recess when the valve closes.

6. A valve as in claim 1, wherein the biasing means comprises a spring element mounted between the blade element and the valve plate.

7. A valve as in claim 6, wherein the spring element is a spring steel blade with a bent end portion which is maintained externally to the respective recess when pressure balance is obtained between the upstream and downstream regions of the valve.

8. A valve as in claim 1, wherein the sealing portion of the blade element is kept free from the actuation of the biasing means when said sealing portion is displaced between the partial opening position and said maximum opening position of the valve.

9. A valve as in claim 1 wherein said blade element is planar in the absence of a biasing force.

10. A valve for a hermetic compressor, the compressor including a cylinder with a piston movable therein, a valve plate on one end of the cylinder, said valve plate having a pair of passages therethrough, one end in communication respectively with the suction and discharge chambers, of the cylinder, an outlet end of each passage on a face of the valve plate, a reed valve for each passage, each reed valve comprising a blade element having one part attached to the valve plate and a part for sealing the outlet end of its respective passage, and means for biasing the sealing part of each blade to a partial opening condition of the valve, the biasing being dimensioned to instantly displace the sealing portion of the blade element to said partial opening upon a pressure balance between the upstream and downstream region of the valve, the sealing portion of the blade element being displaced to a maximum opening position of the valve when the gas pressure upstream the valve exceeds the gas pressure downstream thereof, and to a closing position, in which the valve is kept, against the action of the biasing means, whenever the gas pressure downstream the valve exceeds the gas pressure upstream thereof.

11. A valve as in claim 9 wherein said blade element is planar in the absence of a biasing force.

* * * * *